US006805517B2

(12) United States Patent
Chapek

(10) Patent No.: US 6,805,517 B2
(45) Date of Patent: Oct. 19, 2004

(54) GUTTERLESS DRAINAGE SYSTEM

(76) Inventor: William H. Chapek, 9511 Wildwood Cir., Chardon, OH (US) 44024

( * ) Notice: Subject to any disclaimer, the term of this patent is extended or adjusted under 35 U.S.C. 154(b) by 0 days.

(21) Appl. No.: 10/189,683

(22) Filed: Jul. 8, 2002

(65) Prior Publication Data

US 2004/0005192 A1 Jan. 8, 2004

(51) Int. Cl.[7] ..... E04D 13/00

(52) U.S. Cl. ..... 405/43; 405/36; 52/11; 52/169.5

(58) Field of Search ..... 405/36, 43, 45, 405/118, 119; 52/169.5, 11–16, 302.1, 302.3, 302.4

(56) References Cited

U.S. PATENT DOCUMENTS 186,529 A * 1/1877 Biegelaar ..... 405/121
643,677 A * 2/1900 Payne ..... 404/2
1,031,407 A * 7/1912 Williams ..... 405/121
2,569,568 A * 10/1951 Lipshaw ..... 52/12
2,988,226 A * 6/1961 Campbell ..... 52/12
3,977,135 A * 8/1976 Hunley, Jr. ..... 52/12
4,480,942 A * 11/1984 Farrow ..... 405/184.5
4,844,655 A 7/1989 Aleshire
5,066,165 A 11/1991 Wofford et al.
5,256,000 A 10/1993 Beamer
5,333,417 A * 8/1994 Demartini ..... 52/11
5,333,419 A * 8/1994 Hickner ..... 52/13
5,340,234 A 8/1994 Rossi et al.
5,372,457 A * 12/1994 Rante ..... 405/119
5,443,327 A 8/1995 Akkaya et al.
5,529,436 A * 6/1996 Meyers ..... 405/119
5,551,351 A 9/1996 Hardin
5,647,689 A 7/1997 Gunter
5,718,537 A * 2/1998 Becker et al. ..... 405/119
6,009,672 A * 1/2000 Kuhns ..... 52/13
6,256,933 B1 * 7/2001 Kuhns ..... 52/13

* cited by examiner

*Primary Examiner*—Frederick L. Lagman
(74) *Attorney, Agent, or Firm*—James A. Hudak

(57) ABSTRACT

A drainage system for a structure which does not utilize gutters and/or downspouts is disclosed. The drainage system is comprised of a trough, a plurality of interconnected conduits received within the trough, a frame member received on the plurality of interconnected conduits and a grate member received on the frame member. The drainage system is installed directly under the eaves of the structure where gutters would typically be installed. Rain water and/or melted snow drips from the eaves and passes through openings between adjacent slats in the grate member into the plurality of interconnected conduits for passage therethrough to a pond or a storm sewer system. In this manner, the drainage system for the exterior of the structure does not require the use of gutters.

5 Claims, 6 Drawing Sheets

GUTTERLESS DRAINAGE SYSTEM

TECHNICAL FIELD

The present invention relates, in general, to a drainage system for a residence or building and, more particularly, to a rain water and/or melted snow drainage system that does not utilize gutters.

BACKGROUND ART

Rain water and/melted snow is typically removed from the roof of a residence or building by means of a gutter system. The gutters are attached along the eaves of the roof and allow the rain water and/or melted snow to pass therethrough to downspouts which are connected to a drain pipe which directs the rain water and/or melted snow to a location at grade level near the residence or building. Alternatively, the drain pipe can convey the rain water and/or melted snow to a storm sewer system. The gutters and downspouts typically become clogged with debris and leaves, particularly if the residence or building is in a wooded area. Such decaying debris and leaves, in combination with stagnant water within the gutters, breeds insects, mold and vegetation. Clogged gutters also provide a trap for snow and ice buildup causing the formation of ice dams, premature roofing failure at the eaves, and possible water leaks resulting in damage to the interior of the structure. Clogged gutters may also become detached from the structure due to their weight. Because of this, gutters and downspouts typically require cleaning at least semi-annually. In order to clean the gutters and downspouts, one must use a ladder which can create a hazardous situation. On steeper pitch roofs, frequent movement of the ladder increases a person's chances of falling. Additionally, it may be difficult or impossible for an elderly and/or disabled person to undertake the cleaning task, particularly if a ladder is required. Furthermore, using a professional service to clean gutters and downspouts can be a rather costly undertaking. Gutter guards and/or screening may be attached to the top surface of the gutters, however, such guards and/or screening still require maintenance, can be expensive to install, and can cause ice/water backups.

In view of the foregoing, it has become desirable to develop a rain water and/or melted snow drainage system for residences or buildings which does not utilize gutters.

SUMMARY OF THE INVENTION

The present invention solves the problems associated with presently available rain water and/or melted snow drainage systems which utilize gutters, and other problems, by providing a drainage system comprising a trough, a plurality of interconnected conduits received within the trough, a frame member received over the plurality of interconnected conduits, and a grate member received over the frame member. The foregoing drainage system is installed directly under the eaves of the residence or building where gutters would typically be installed. In this manner, rain water and/or melted snow can drip from the eaves and pass through the openings between adjacent slats in the grate member into the plurality of interconnected conduits which are positioned below grade level and pitched to empty the rain water and/or melted snow into a pond, ditch or storm sewer. Alternatively, the interconnected conduits can terminate at or above grade level at a distance away from the residence or building. Thus, the present invention provides a rain water and/or melted snow drainage system for the perimeter of a residence or building without the use of gutters, thus, overcoming the problems associated with drainage systems which utilize gutters.

DESCRIPTION OF THE PREFERRED EMBODIMENT

Figure 4:
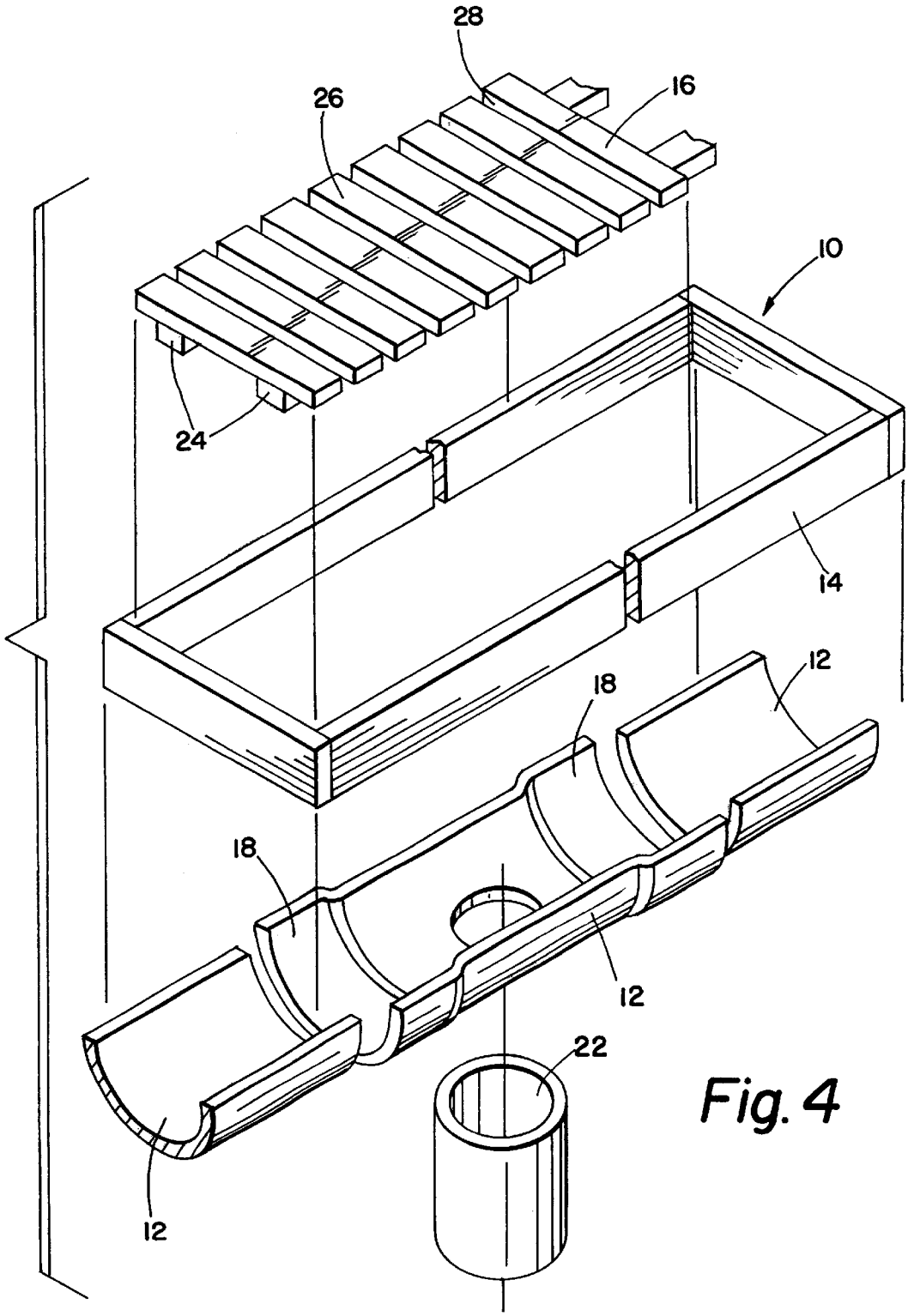
FIG. 4 is an exploded, perspective view of the gutterless drainage system of the present invention.
Figure 5:
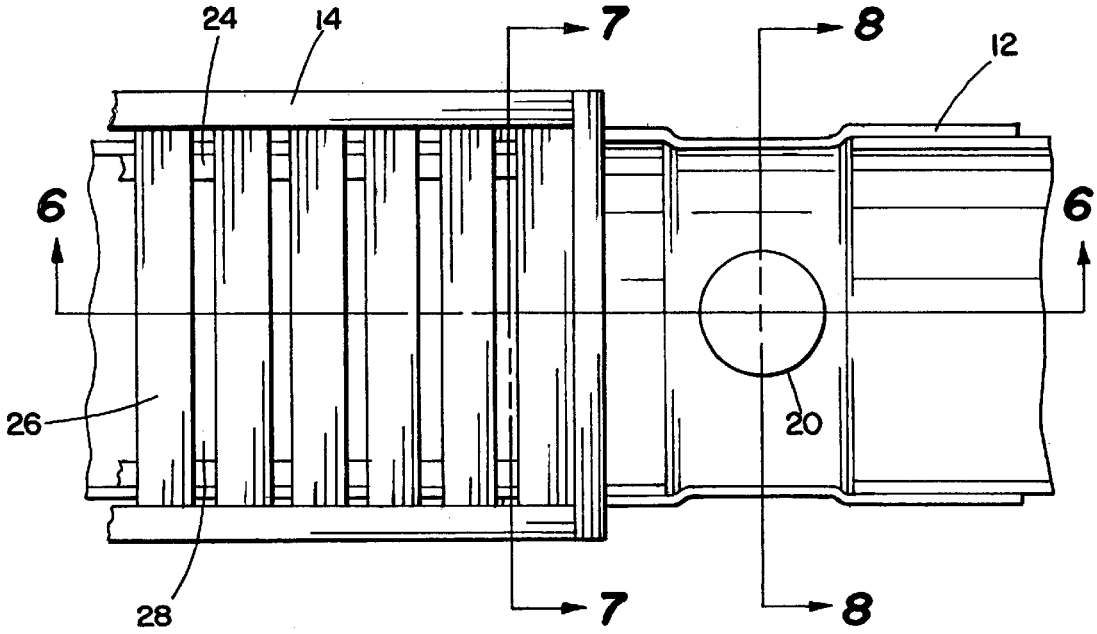
FIG. 5 is a top plan view of the gutterless drainage system of the present invention.
Figure 6:
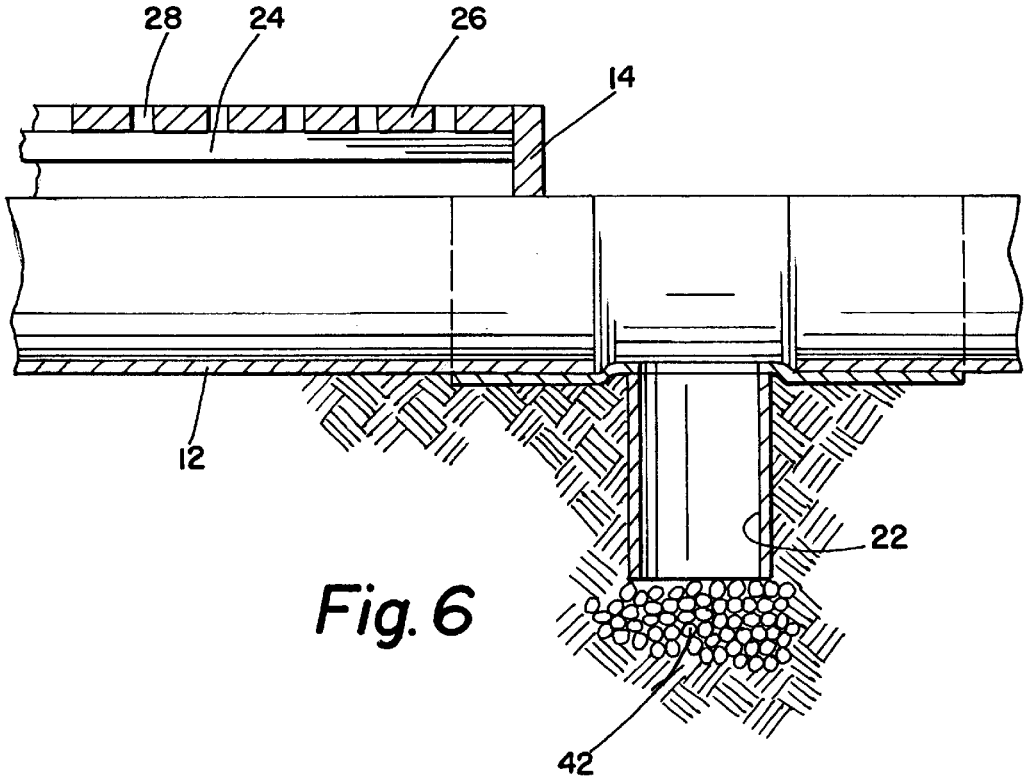
FIG. 6 is a cross-sectional view of the gutterless drainage system of the present invention taken across section-indicating lines 6—6 in FIG. 5.
Figure 7:
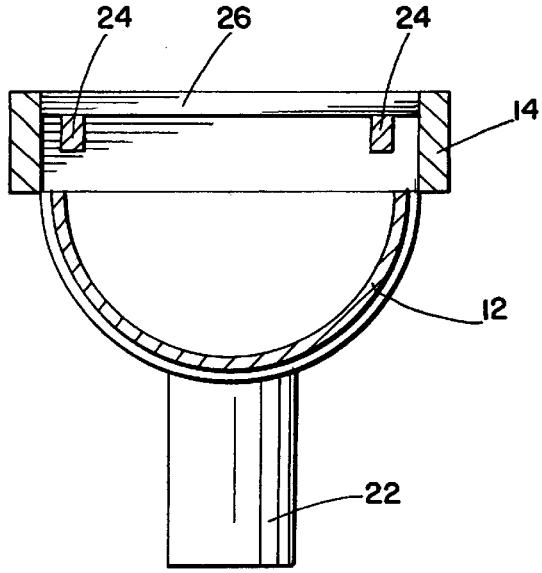
FIG. 7 is a cross-sectional view of the gutterless drainage system of the present invention taken across section-indicating lines 7—7 in FIG. 5.
Figure 8:
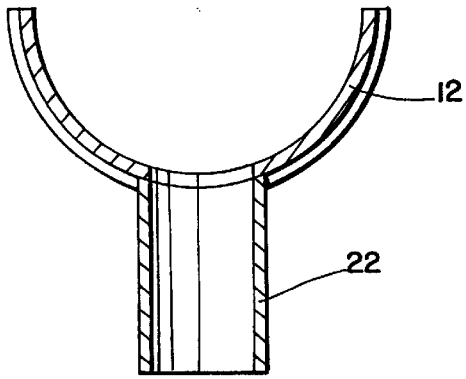
FIG. 8 is a cross-sectional view of the gutterless drainage system of the present invention taken across section-indicating lines 8—8 in FIG. 5.
Figure 9:
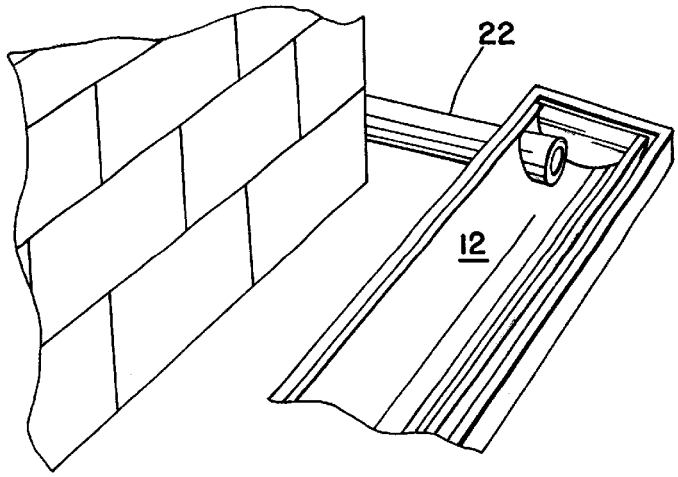
FIG. 9 is a perspective view illustrating the use of a conduit member as an input drain to the gutterless drainage system of the present invention.
Figure 10:
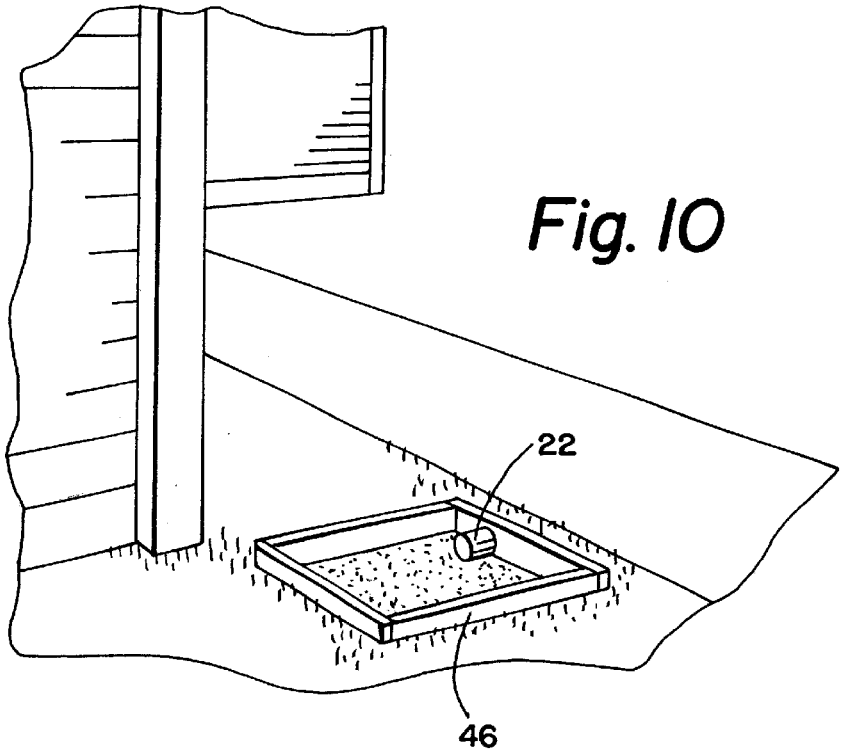
FIG. 10 is a perspective view, similar to FIG. 3, illustrating the frame member which supports the grate member under a valley which occurs on a roof.

Referring now to the Figures where the illustrations are for the purpose of describing the preferred embodiment of the present invention and are not intended to limit the invention disclosed herein, FIG. 4 is an exploded, perspective view of the gutterless drainage system 10 of the present invention. As shown in FIG. 4, the gutterless drainage system 10 is comprised of a plurality of interconnected conduits 12, a frame member 14 and a grate member 16. The plurality of interconnected conduits 12 are typically formed from a plastic material and have a semi-circular configuration in cross-section. The ends 18 of the conduits 12 may have a bell-shape to receive a mating end of an adjacent conduit 12. In addition, an aperture 20 may be provided in the conduits 12 to receive a discharge conduit 22. The frame member 14 may be formed from wood or plastic and is received over the plurality of interconnected conduits 12, as shown in FIGS. 5 and 6, and is sized so as to receive the grate member 16 thereon. The grate member 16 may be formed from wood or plastic and is comprised of two parallel runners 24 having a plurality of slats 26 attached to the top surface thereof. The plurality of slats 26 are in a spaced-apart relationship providing gaps 28 between adjacent slats 28 permitting rain water and/or melted snow to pass therethrough into the plurality of interconnected conduits 12.

Figure 1:
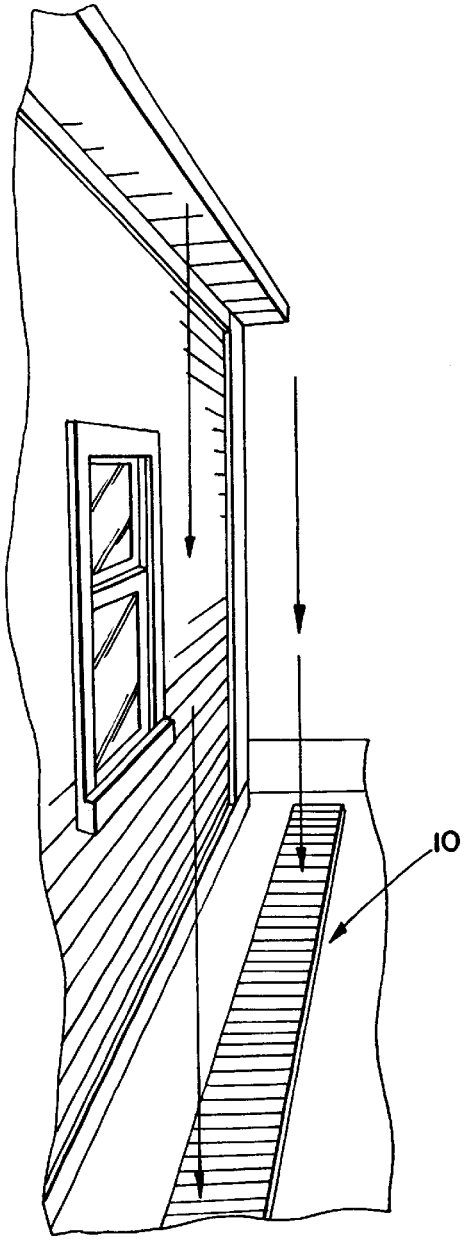
FIG. 1 is a perspective view of the gutterless drainage system of the present invention installed under the eaves of a residence or building.
Figure 2:
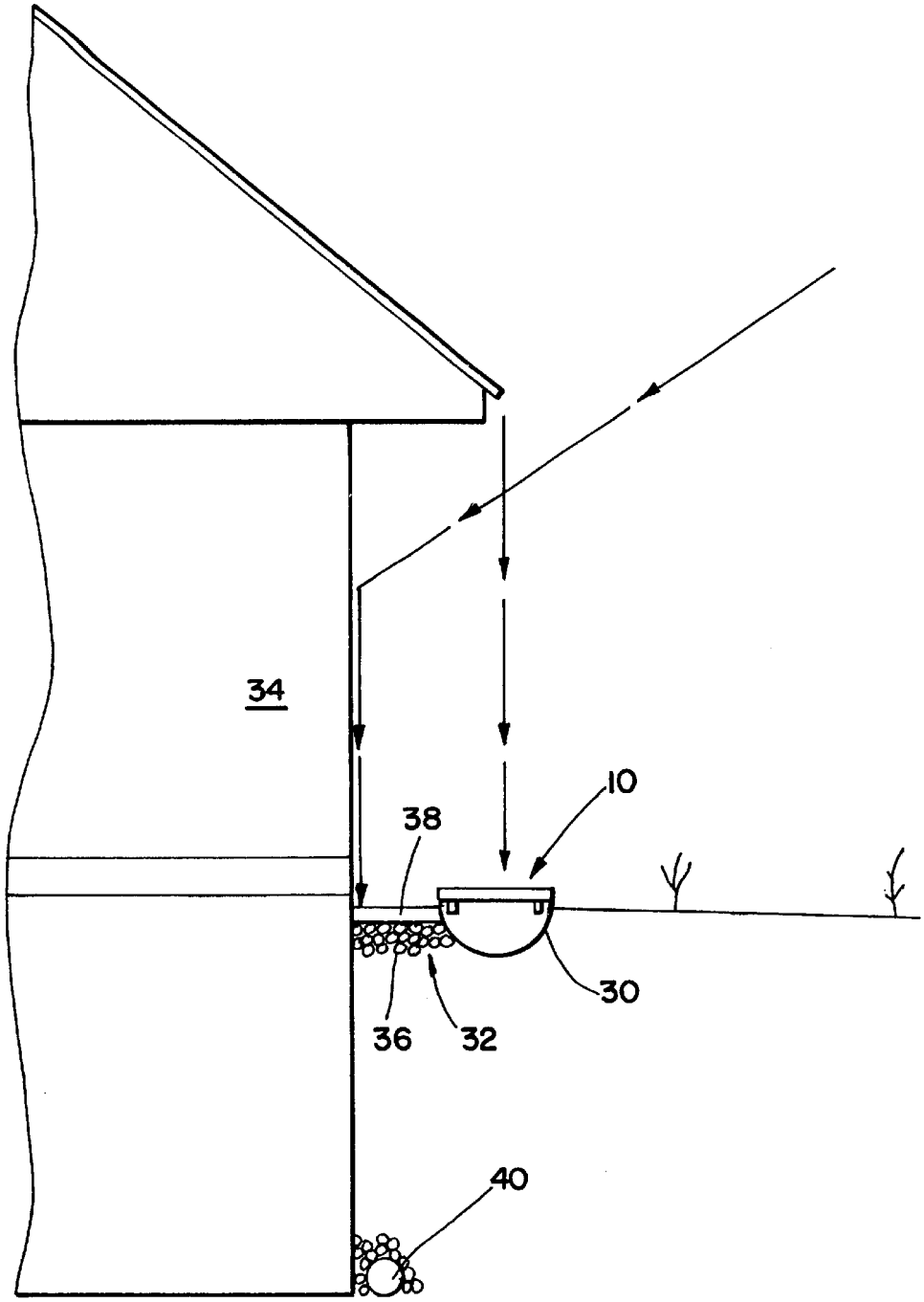
FIG. 2 is an elevational view, partially broken away in cross-section, illustrating the installation of the gutterless drainage system of the present invention and showing the positioning of same with respect to the residence of building and the eaves on same.

Referring now to FIGS. 1 and 2, the installation of the gutterless drainage system 10 of the present invention is illustrated. A trough 30 is dug under the eaves of a residence or building to accommodate the gutterless drainage system 10. The trough 30 is located directly under the end of the eaves and positioned where gutters would typically be placed. The trough 30 and the area, designated by the numeral 32, between the trough 30 and the edge of the residence or building 34 are lined with compacted gravel or sand 36. The gutterless drainage system 10 is then received within the trough 30 and positioned so that the top surface of grate member 16 is at grade level and pitched so that rain water and/or melted snow will pass therethrough. The compacted gravel or sand 36 in area 32 is then covered with a layer of concrete 38, thus "sealing" the gutterless drainage system 10 to the foundation of the residence or building 34. In this manner, all rain water and/or melted snow from the roof of the structure and any wind-driven rain or snow that might strike the sides of the structure will be captured by the gutterless drainage system 10. In addition, moisture leaching into the foundation of the structure or its footer drains 40 is virtually eliminated.

Figure 3:
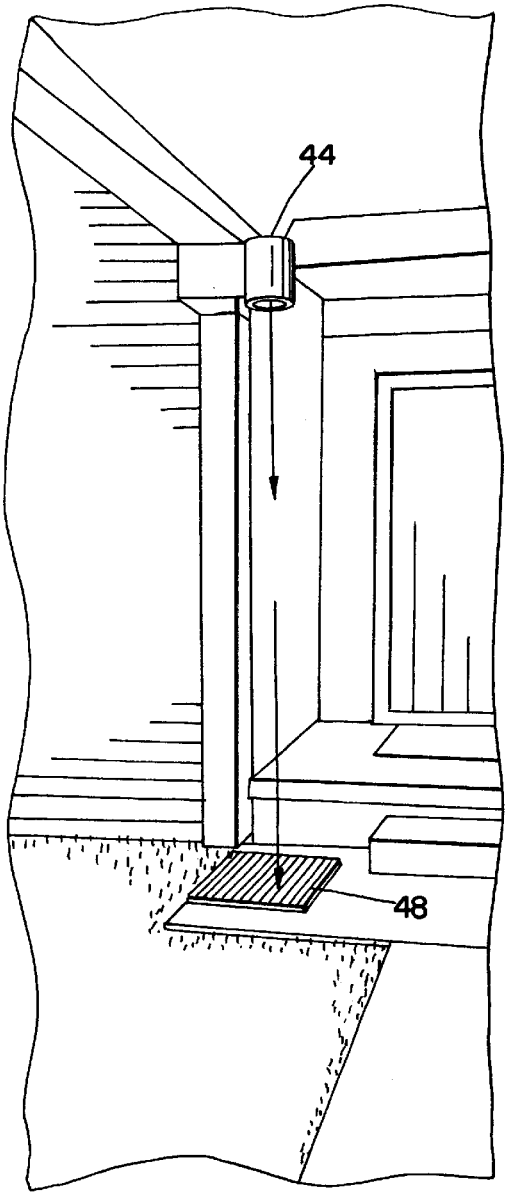
FIG. 3 is a perspective view of the gutterless drainage system of the present invention installed under a valley which occurs on a roof, i.e., where two roof surfaces come together, on a residence or building.
Figure 11:
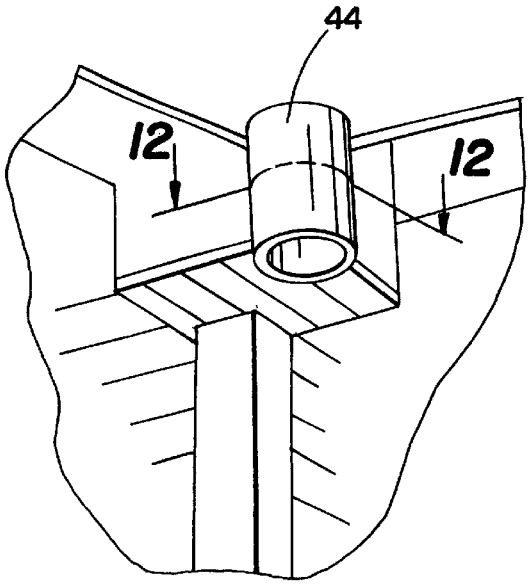
FIG. 11 is a perspective view of the deflector which is utilized to deflect rain water and/or melted snow from a valley which occurs on a roof.
Figure 12:
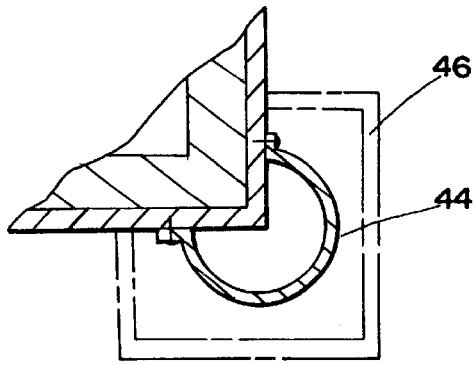
FIG. 12 is a cross-sectional view of the deflector which is utilized to deflect rain water and/or melted snow from a valley which occurs on a roof and taken across section-indicating lines 12—12 in FIG. 11.

Rain water and/or melted snow draining from the roof "rolls off" of the eaves, passes through the gaps 28 in the grate member 16 and is received within the plurality of interconnected conduits 12 for drainage through discharge conduit 22 for absorption through a stone bed or "dry" well 42, as shown in FIG. 6, or for passage to a pond or a storm sewer (not shown). If a stone bed or "dry" well 42 is utilized, it should be located at a distance away from the structure. Where a valley occurs in a roof, i.e., where two roof surfaces come together, the flashing in the valley diverts the rain water and/or melted snow to a deflector 44, as shown in FIGS. 11 and 12, which is placed over a frame member 46, as shown in FIG. 3. The frame member 46 is constructed similar to frame member 14, shown in FIG. 4, and has a grate member 48 positioned thereon. The grate member 48 also has a plurality of spaced-apart slats (not shown) thereon permitting rain water and/or melted snow to pass therethrough. The frame member 46 is, in turn, interconnected to the aforementioned drainage systems 10. As shown in FIGS. 11 and 12, the deflector 44 is cylindrical in configuration, however, other configurations can be utilized. As can be seen, by using the present invention, gutters are not required on the residence or building.

The present invention provides a number of advantages over presently used gutters and downspouts on residences or buildings. Such gutters and downspouts typically must be cleaned at least semi-annually in order to remove debris and leaves therefrom. If the downspouts are not properly maintained, the downspouts can clog requiring "snaking" to clean same or the replacement of the downspouts. Clogged gutters also retain decaying debris and stagnant water which breeds insects, mold and/or vegetation. Such clogged gutters may become unsightly and may become detached from the structure due to the weight of same. Clogged gutters also provide a trap for snow and ice causing ice dams, premature roofing failure at the eaves and possible leaks resulting in damage to the interior of the structure to which they are attached.

In order to clean the gutters, a person typically has to use a ladder which creates a hazardous situation since a person can readily fall from same. On steeper pitch roofs, frequent movement of the ladder increases the chances of a person falling. In addition, it may be difficult or impossible for an elderly or disabled person to undertake such a cleaning process, particularly if a ladder is required. Furthermore, the gutter cleaning process can be rather costly if one employs an outside contractor for same. In some instances, gutter guards and/or screening may be installed on the top surface of the gutters in order to minimize gutter clogging. In most instances, such gutter guards and/or screening seldom perform as advertised and still require maintenance to clean same and can cause ice/water backups. Such gutter guards and/or screening can also be expensive to install and/or replace.

The gutterless drainage system 10 of the present invention collects rain water and/or melted snow and directs same away from the structure. By directing the rain water and/or melted snow away from the structure, water in the footer drains and against the foundation of the structure is substantially reduced, resulting in a "drying" effect on the structure. In addition, the present invention minimizes erosion or the "ditching" effect of rain water on ground surfaces which hinders proper growth of lawn, destroys landscape bushes or other plantings and erodes walkways, drives, etc. The present invention also eliminates ice/water back-up and damage to the roof and leakage to the interior of the structure. With respect to maintenance, the present invention can be readily cleaned without the use of ladders. In order to clean the present invention, the grate members 16, 48 are easily removed, and the plurality of interconnected conduits 12 and discharge conduits 22 can be readily cleaned with a garden hose. Such cleaning can be done by practically anyone resulting in a substantial cost savings. In addition, in comparison to gutter type drainage systems, maintenance of the present invention is substantially reduced since there is less likelihood of clogging of the present invention and no repairs are required for loose or fallen gutters.

Certain modifications and improvements will occur to those skilled in the art upon reading the foregoing. It is understood that all such modifications and improvements have been deleted herein for the sake of conciseness and readability, but are properly within the scope of the following claims.

I claim:

1. A drainage system for a structure having a roof from which rain water and/or melted snow are to be conveyed comprising a plurality of interconnected conduit members, said conduit members being placed around the periphery of said structure and positioned under the eaves of said structures where gutters would ordinarily be placed and being substantially aligned with the outer edge of said roof, each conduit member having a bell-shaped configuration at one end thereof permitting the interconnection of said conduit members, said bell-shaped configuration at said one end of said each conduit member being continuously curved in the radial direction causing said bell-shaped configuration to be substantially semi-circular in cross-section, a frame member received over said plurality of said interconnected conduit members, a grate member supported by said frame member so as to be positioned above and spaced-apart from said plurality of said interconnected conduit members, and an outlet member connected to said plurality of said interconnected conduit members.

2. The drainage system as defined in claim 1 wherein said grate member is comprised of a plurality of spaced-apart slat members and at least two runners, said slat members being attached to said runners.

3. The drainage system as defined in claim 1 wherein said outlet member is directed to a pond.

4. The drainage system as defined in claim 1 wherein said outlet member is directed to a storm sewer system.

5. A drainage system comprising a plurality of interconnected conduit members, each conduit member having a bell-shaped configuration at one end thereof permitting the interconnection of said conduit members, a frame member received over said plurality of said interconnected conduit members, a grate member supported by said frame member so as to be positioned above said plurality of interconnected conduit members, an outlet member connected to said plurality of interconnected conduit members, and a deflector member attached to the roof of the structure from which rain water and/or melted snow are being conveyed and positioned adjacent a valley formed at the junction of two roof structures in the roof of said structure, said deflector member having a cylindrical tubular configuration.

* * * * *